United States Patent [19]

Curry et al.

[11] 4,085,895

[45] Apr. 25, 1978

[54] ADJUSTABLE SPRAY DEVICE

[76] Inventors: Byron V. Curry, 1150 Oriole Rd., Montecito; Michael G. Walton, P.O. Box 5638, Santa Barbara, both of Calif. 93108

[21] Appl. No.: 781,138

[22] Filed: Mar. 25, 1977

[51] Int. Cl.[2] ..... A62C 31/22

[52] U.S. Cl. ..... 239/276; 239/285; 239/538; 239/562

[58] Field of Search ..... 239/271, 276, 285, 451, 239/538, 542, 553, 562, 581, 590, DIG. 1

[56] References Cited

U.S. PATENT DOCUMENTS

| | | | |
|---|---|---|---|
| 3,397,541 | 8/1968 | Kersh | 239/271 X |
| 3,613,995 | 10/1971 | Kane | 239/451 X |
| 3,638,863 | 2/1972 | Roberts | 239/276 |
| 3,788,552 | 1/1974 | Roberts | 239/276 |

*Primary Examiner*—Robert W. Saifer
*Attorney, Agent, or Firm*—Spensley, Horn & Lubitz

[57] ABSTRACT

A simple, two-part adjustable spray device is disclosed, the device consisting of a tubular member within which is a cylindrical insert member. At its inner end, the insert member includes a chamber in selective communication with both the inlet portion of the tubular member and a longitudinal channel formed in the internal wall of the outlet portion of the tubular member. The side wall of the insert member defining the chamber is sufficiently flexible to be distended by the pressure of liquid within the chamber into a sealing engagement with the interior side wall of the tubular member. By rotationally adjusting the insert member, the chamber may be brought into selective communication with the longitudinal channel to allow a varying volume of liquid to pass from the inlet to the outlet and a spray of liquid to be emitted through a profiled aperture. The tubular member and the insert member may include interlocking shoulders with serrations to hold the insert member in a multiplicity of rotational positions within the tubular member.

16 Claims, 14 Drawing Figures

ADJUSTABLE SPRAY DEVICE

BACKGROUND OF THE INVENTION

This invention relates to an adjustable spray device, particularly one of simple, self-sealing construction.

Several devices are in use for irrigating plants and the like which distribute water in a fan-like spray or jet. They are designed to be attached directly to a manifold pipe or to be supplied with liquid by narrow, flexible tubing attached to the manifold pipe. In contrast to drip irrigation systems, these spray devices typically distribute a larger volume of water over a wide area of soil in a shorter period of time. There is a trend to combine the advantages of spray and drip irrigation systems in a "mini-sprinkler" system for both orchards and the production of container grown stock in nurseries, as well as in landscaping situations. Such systems combine the advantages of savings in water and labor offered by drip irrigation without requiring an expensive and onerous filtration system. Also, the greater volume of water they dispense helps to leach the soil of harmful salt build-ups.

In many situations it is desirable to be able to adjust or vary the volume of irrigating water being delivered from each irrigating device, both because different sizes and types of plants require differing amounts of water and because pressure changes in the manifold, brought about by friction losses or changes in grade, cause differences in the volume of liquid disbursed from device to device within the system. In container nurseries it is often desirable to shut off individual plant watering devices completely when a plant is removed without also shutting off irrigation of the remaining plants. Further, it is frequently advantageous to be able to vary the liquid distribution pattern of the device from a full circle to a narrow arc. Another problem facing installations of spray devices attached directly to a flexible manifold is the tendency for the pipe to twist, distort or move under changes in temperature, pressure or other conditions, with a consequent misdirection of the spray.

The invention herein described is addressed to these problems, providing a device which not only offers many significant advantages over other, previous irrigating devices, but which also is simple in construction and economical to manufacture.

BRIEF DESCRIPTION OF THE INVENTION

The adjustable spray device structure consists of two parts: a cylindrical tubular member and an insert member fitted within one end of the tubular member, the other end of the tubular member being a fluid entry port. Preferably, a restrictive throat is formed within the tubular member against which the base of the insert is seated. A longitudinal channel is provided in the internal wall of the tubular member adjacent the insert member and extends from near the throat to a profiled aperture in the outlet rim of the tubular member. The insert member has a flared head seating on the rim and is held in place within the tubular member preferably by an indexing bead or shoulder.

A chamber is constructed in the base of the insert, in fluid communication with the throat, and an orifice is provided in the chamber wall. The remainder of the chamber wall is sufficiently flexible to be distended by the pressure of liquid within the chamber into a sealing engagement with the interior side wall of the tubular member. The orifice may be selectively aligned with the longitudinal channel to allow passage of fluid from the chamber into the channel. This flow strikes the flared head of the insert, and is dispensed as a spray in an arc defined by the profile of the aperture in the rim. As the insert member is rotated, progressively less fluid is allowed to pass into the channel until finally, none passes.

A winged extension to the flared head of the insert member may be provided to adjust the device by hand. In one embodiment this winged extension also provides a ground penetrating stem, permitting the device to be located in the soil adjacent ot a plant and the emergent spray to be directed as required. In another embodiment the device is inserted directly into either a manifold pipe, or a riser member being sealed thereto by screw threads, solvent-welding or by a barb formed on the exterior of the fluid entry port. Means such as an extension or stem through which a locating peg is passed are provided to prevent the device from twisting out of alignment when attached to a flexible manifold and to direct the emergent spray as required. To achieve a multi-directional spray pattern, several longitudinal channels and apertures may be included in the tubular member, with a corresponding number of outlet orifices in the chamber wall at the base of the insert. Various different flow rates may be provided by several orifices of different size in the insert chamber wall, which orifices may be brought into selective communication with the channel.

BRIEF DESCRIPTION OF THE DRAWINGS

The invention will be further described in connection with the accompanying drawings, in which.

DETAILED DESCRIPTION OF PREFERRED EMBODIMENTS

Figure 1:
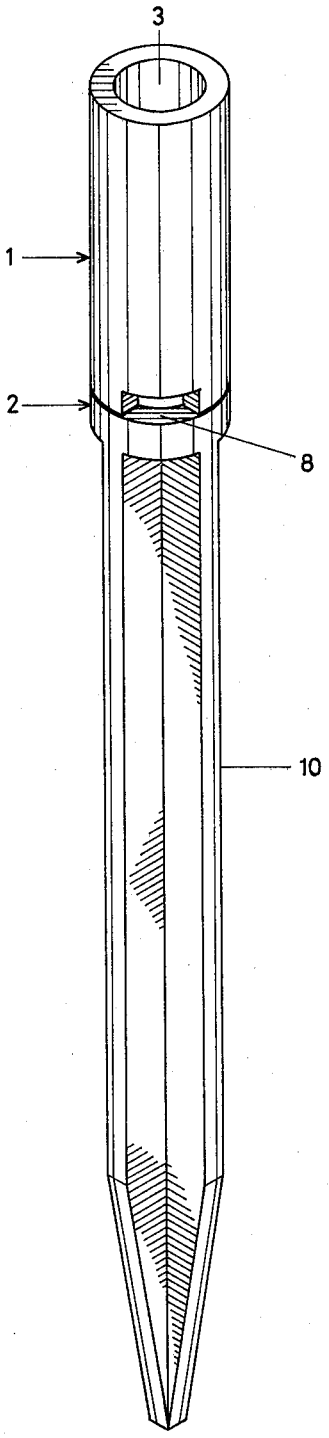
FIG. 1 is a front perspective view of one form of the adjustable spray device with a ground-penetrating stem.
Figure 2:
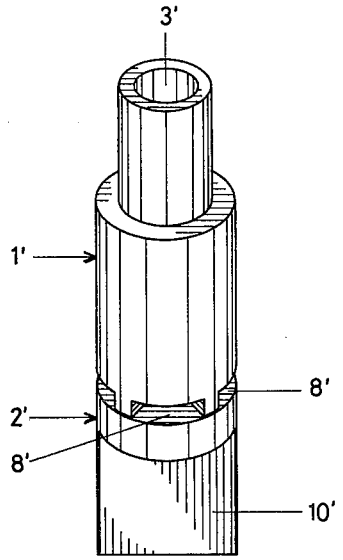
FIG. 2 is a front perspective view of another form of the adjustable spray device with multiple ports.
Figure 4:
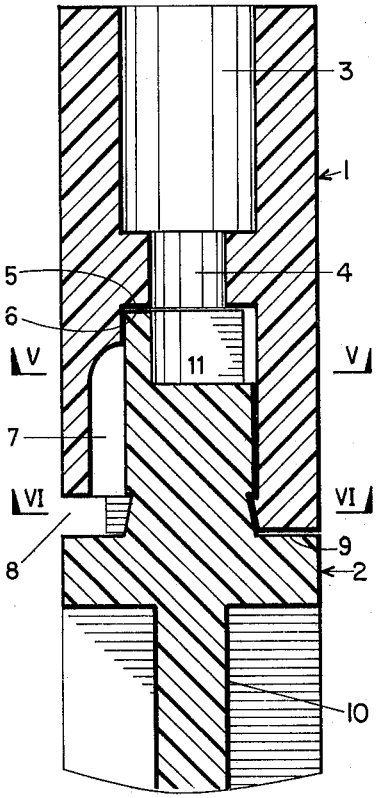
FIG. 4 is a view of the preferred embodiment in vertical cross-section.

The adjustable spray plant watering device is a two part structure which, as shown for example in FIG. 1, comprises a tubular member 1 into one end of which is fitted a cylindrical insert member 2, the opposite end being a fluid entry port 3. Within the device, as shown for example in FIG. 4, a restrictive throat 4 is formed, providing a flange 5 against which the base 6 of the insert is seated, and also to provide a stop for the end of a section of flexible tubing which may be inserted into the fluid entry port (see for example FIG. 10). A longitudinal channel or groove 7 is constructed in the wall of the tubular member extending from a point near the restrictive throat 4 to a profiled aperture or orifice 8 in the lower rim of the tubular member remote from the fluid entry port.

The head of the insert member is enlarged to provide a flared head 9 that extends over the lower rim of the tubular member and abuts against it. A protuberance 10 extends away from this head. This protuberance may be grasped manually and rotated with respect to the tubular member 1. Of course, various other structures, such as a slot for a screwdriver, would accomplish the same end if desired.

Figure 7:
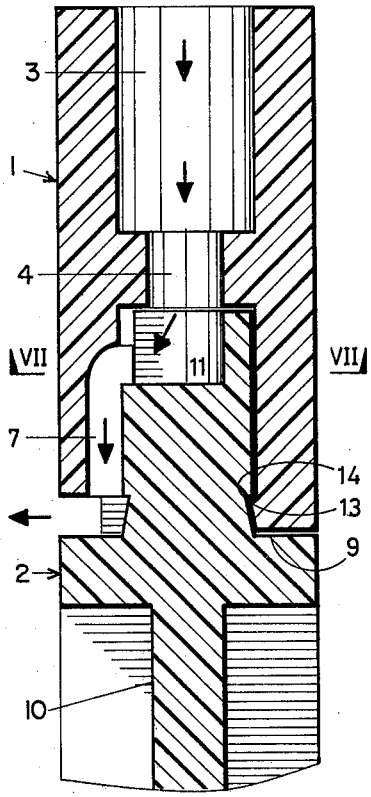
FIG. 7 is a view in vertical cross-section similar to FIG. 4 but showing the device in the fully open position.
Figure 10:
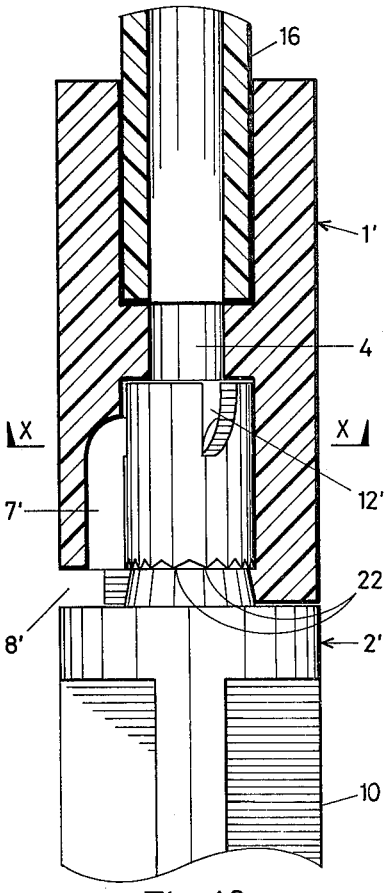
FIG. 10 is a view in vertical cross-section similar to FIG. 4 but illustrating another embodiment of the device.
Figure 5:
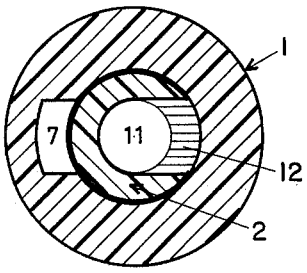
FIG. 5 is a horizontal cross-section taken on lines V—V of FIG. 4 with the insert in the "closed" position.
Figure 8:
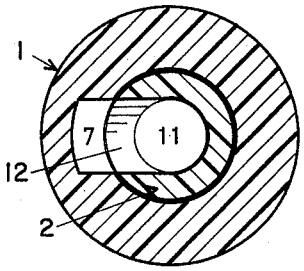
FIG. 8 is a horizontal cross-section taken on lines VII—VII of FIG. 7.
Figure 6:
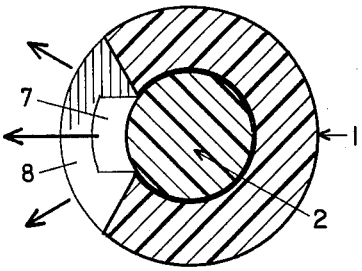
FIG. 6 is a horizontal cross-section taken on lines VI—VI of FIG. 4.
Figure 9:
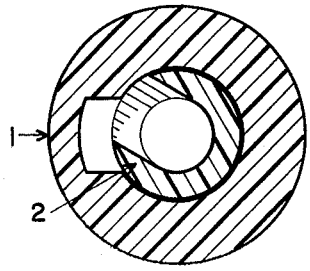
FIG. 9 is a view in horizontal cross-section similar to FIG. 8 but showing the device in another rotational adjustment.

A chamber 11 is provided in the base of the insert. The diameter of the chamber is similar to that of the restrictive throat 4, and is in fluid communication therewith. An orifice 12 is constructed in the chamber wall which, when aligned with the channel 7, (as shown in FIGS. 7 and 8), provides a path for fluid to pass from the chamber 11 into the channel 7. This flow strikes the flared head 9 and is directed as a predominantly planar spray in an arc defined by the width, depth and profile of the aperture 8 (see FIG. 6). As the insert 2 is progressively rotated (see FIG. 9), the path for fluid between the chamber 11 and the channel 7 is increasingly obstructed, thus reducing the flow, until the orifice 12 is misaligned with the channel (as shown in FIG. 5) and no fluid is able to pass from the inlet to the outlet. The size, shape and cross-section of the channel 7, together with the depth and profile of the aperture 8 in the rim of the tubular member 1, determine the maximum volume and direction of the emergent spray. A finer degree of volume adjustment may be obtained when the orifice between the chamber and the longitudinal channel is reduced in area as the insert is rotated to the "off" position. For example, the orifice 12' may be shaped as illustrated in FIG. 10. Preferably, the orifice is shaped to vary the volume of liquid emitted from the device in a generally linear fashion as a function of angular change in the rotational adjustment of the insert member although of course other, non-linear designs may be preferable for some applications.

Because of the longitudinal channel in the tubular member, the flow from chamber 11, whatever its volume, will substantially completely fill this channel and will therefore be emitted throughout the arc in a spray pattern defined by the profiled aperture 8. In contrast, if an aperture were provided in the side of the tubular member adjacent chamber 11, the spray pattern would be limited, or varied, by the rotational adjustment of the chamber relative to the aperture.

When fluid is prevented from passing from the chamber 11 into the channel 7, static pressure builds up in the chamber. The insert member is formed with walls defining chamber 11 that are sufficiently flexible to distend into a close-fitting, liquid tight contact with the inner wall of the tubular member 1 to minimize the possibility of leakage.

To prevent the expulsion of the insert 2 from the tubular member 1 by static pressure, an annular shoulder 13 is provided on the inner wall of the tubular member indexing an indented ring 14 on the shank of the insert 2. These interlocking circumferential shoulders may be serrated as shown in FIG. 10, the interlocking serrations 15 holding the insert member in a positive fashion in a multiplicity of rotational positions within the tubular member. Other means for achieving this function will be apparent to those skilled in this art; for example, longitudinal nibs may be provided on the shank of the insert member indexing the channel 7.

Figure 11:
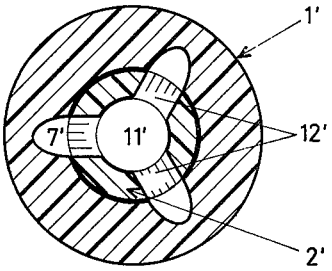
FIG. 11 is a horizontal cross-section taken on lines X—X of FIG. 10.
Figure 12:
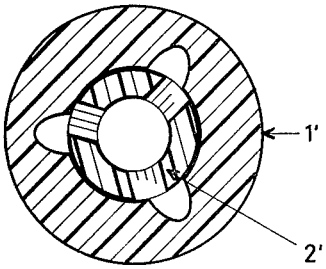
FIG. 12 is a view similar to FIG. 11 but showing the device in a different rotational adjustment.

As illustrated in FIGS. 10 to 12, several channels 7' may be formed in the wall of the tubular member 1', communicating with several apertures 8' in the rim, with a corresponding number of orifices 12' in the base of the insert. Such an arrangement distributes fluid as a multi-directional, adjustable spray. Furthermore, if alternative flow rates are required, several orifices in the chamber wall of shapes substantially different than the inlet portion of the channel 7' in the tubular member 1', and with areas corresponding to the desired flow rates may be provided which orifices selectively may be brought into communication with the channel by selective rotation of the insert with respect to the enclosing tubular member.

Two preferred embodiments are illustrated for locating the device relative to an area to be sprayed. In one, shown in FIG. 1 the protuberance 10 on the head of the insert 2 is extended into a ground penetrating stem which both provides means to support and locate the structure in the soil surrounding a plant, and means to adjust the volume of spray by its rotation as previously described. The stem may by reinforced by ribs if desired, and shaped to a point at the remote end to facilitate insertion in the ground. In this embodiment fluid is preferably supplied to the device by flexible tubing 16 (see FIG. 10) from a manifold, enabling the structure to be moved from one location to another as desired. Of course, at least several alternate methods may be used to attach the tubing 16 to the fluid entry port 3. It may be received within the fluid entry port of the inlet member, or surround that member, or be threaded into that member for example. Where the material of the tubing and the tubular member is compatible, for example PVC, the joint may be formed by solvent-welding which prevents the possibility of disassociation of the structure from the tubing under pressure or temperature changes. The tubing may also be held in place by a frictional fit, aided by barbs or similar devices incorporated in the body of the tubular member.

Figure 3:
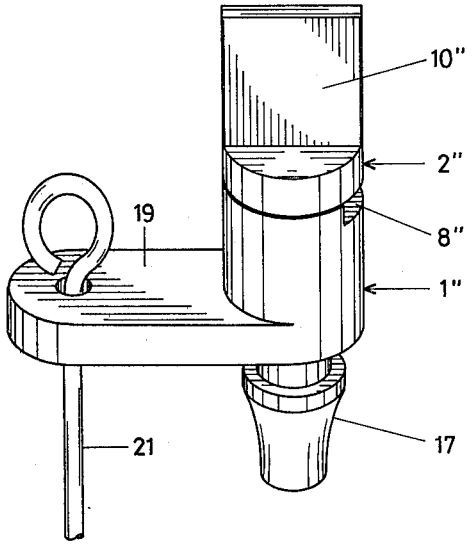
FIG. 3 is a front perspective view of still another form of the adjustable spray device.
Figure 13:
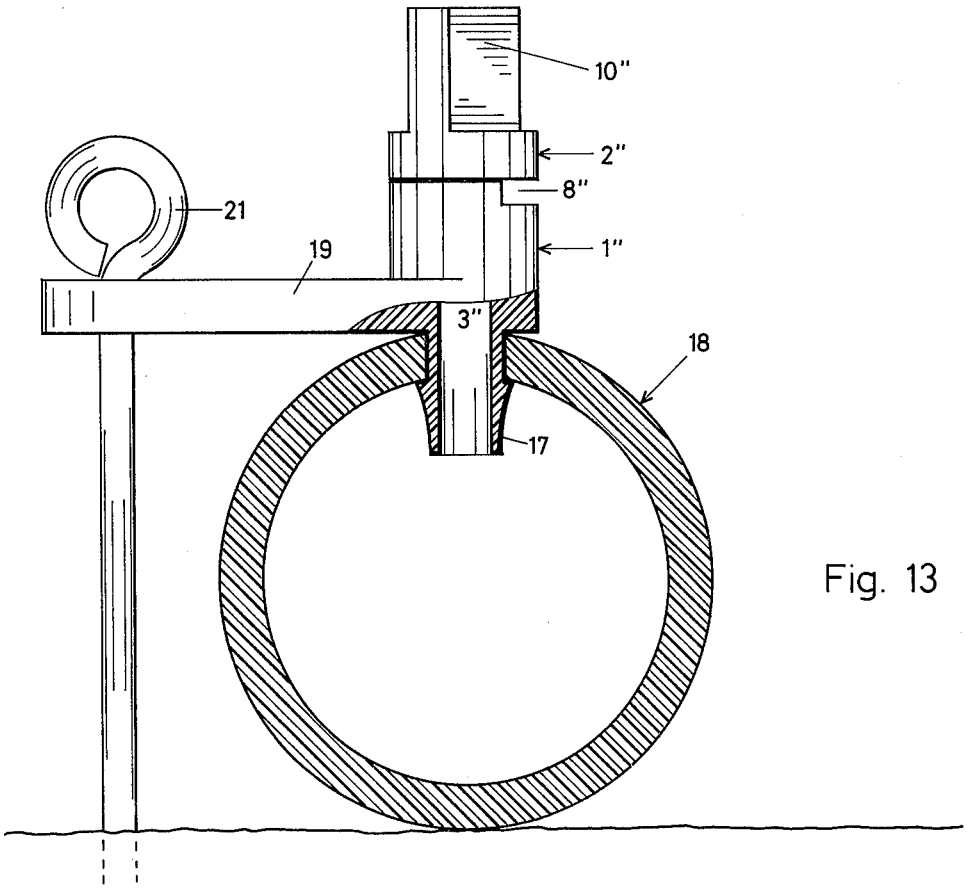
FIG. 13 is a front view, partially in vertical cross-section showing the device illustrated in FIG. 3 received in a manifold line.
Figure 14:
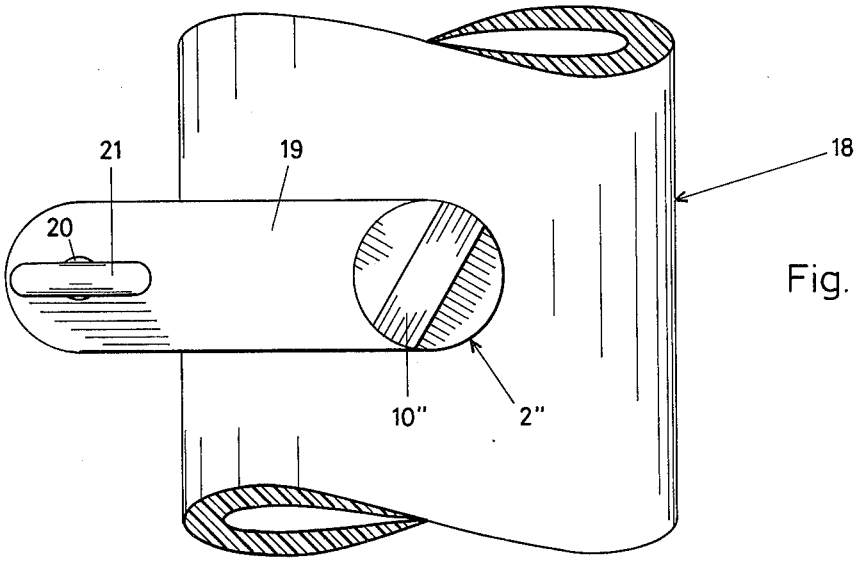
FIG. 14 is a top view of the device shown in FIG. 13.

In the second preferred embodiment for locating the device, illustrated in FIGS. 3, 13 and 14, the structure is inserted directly into an opening in a manifold supply pipe 18. A liquid tight seal may be formed by a threaded connection as described above, or the device may be solvent-welded to the manifold if the materials are compatible, or a barb 17 may be formed on the body of the tubular member 1''. This last method is suitable for use with a flexible manifold in which the structure may be snapped into a pre-drilled hole and the pipe material thereafter contract sufficiently to close around the barb. In this embodiment it is advantageous to provide means to secure the structure in the required position with respect to the ground and to direct the emergent spray. This may be accomplished by providing a protuberance 19 extending laterally from the body of the tubular member 1'', having an orifice 20 in the remote end through which a ground penetrating peg 21 is passed. This fixes the angle and direction of the spray as desired, and prevents the structure from twisting out of the desired alignment should the manifold twist or turn with changes in environmental or internal conditions. The same result may be achieved by other structures too, such as by a lateral protuberance extending out each side of the structure and bending down to terminate at the ground level.

While preferred embodiments of the device have been described, from this teaching modifications will be apparent to those skilled in the art. Accordingly, the scope of the invention is not defined by the preferred structures, but rather is set forth in the following claims.

We claim:

1. An adjustable spray device for receiving liquid under pressure and emitting a spray of a volume determined by the adjustment of the device, the device comprising:

a tubular member including an internal channel of generally circular cross-section, the channel having an inlet portion and an outlet portion, a cylindrical insert member received in the outlet portion of the internal channel of the tubular member, the insert member including a flared head seating against one end of the tubular member, the insert member further including a chamber formed in the end received within the tubular member, the chamber being in fluid communication with the inlet portion of the internal channel within the tubular member, an orifice between the chamber and the internal channel of the outlet portion of the tubular member, the orifice being defined by an opening in the side wall of the insert member, the remainder of the side wall of the insert member being sufficiently flexible to be distended by the pressure of liquid within the chamber into a sealing engagement with the interior side wall of the tubular member, the tubular member also including a longitudinal channel in its side wall extending laterally from an inlet portion adjacent the chamber to an outlet portion adjacent the flared head of the insert member, an aperture for liquid being provided adjacent the junction of the longitudinal channel in the tubular member and the head of the insert member, and means holding the insert member within the tubular member while permitting rotational adjustment of the insert member relative to the tubular member, whereby in one rotational adjustment the chamber orifice will be misaligned with the longitudinal channel in the tubular member and the side wall of the chamber distended into sealing engagement with the tubular member to prevent liquid from flowing through the device, while in another rotational adjustment the orifice will be at least partially aligned with the longitudinal channel to permit liquid to flow through the inlet portion of the tubular member, the chamber in the insert member and the longitudinal channel in the outlet portion of the tubular member to strike against the head of the insert member and be emitted from the aperture.

2. An adjustable spray device as set forth in claim 1 in which the insert member is rotationally adjustable within the tubular member among a multiplicity of positions to vary the volume of liquid emitted by the device from a minimum position in which no liquid is emitted to a maximum position in which a maximum volume of liquid is emitted, there also being a multitude of intermediate positions between the minimum and maximum positions in which intermediate positions different volumes of liquid are emitted.

3. An adjustable spray device as set forth in claim 2 in which the orifice between the chamber in the insert member and the outlet portion of the tubular member is shaped to vary the volume of liquid emitted from the device in a generally linear fashion as a function of angular change in the rotational adjustment of the insert member within the tubular member from a minimum to a maximum volume position.

4. An adjustable spray device as set forth in claim 2 in which the shape of the orifice in the insert member is substantially the same as the shape of the inlet portion of the longitudinal channel of the tubular member.

5. An adjustable spray device as set forth in claim 2 in which the shape of the orifice in the insert member is substantially different than the shape of the inlet portion of the channel of the tubular member.

6. An adjustable spray device as set forth in claim 2 in which the means to hold the insert member within the tubular member includes interlocking circumferential shoulders on the insert member and the tubular member.

7. An adjustable spray device as set forth in claim 6 in which the interlocking shoulders include interlocking serrations to hold the insert member in a multiplicity of rotational positions within the tubular member.

8. An adjustable spray device as set forth in claim 2 including means to rotationally adjust the insert member within the tubular member.

9. An adjustable spray device as set forth in claim 2 in which the tubular member includes a restricted throat portion between the inlet portion and the outlet portion, the restricted throat portion providing a stop against which may bear the end of a flexible liquid supply tube received within the inlet end of the tubular member, the restricted throat being longitudinally in line with the inlet chamber in the insert member.

10. An adjustable spray device as set forth in claim 2 including a multiplicity of longitudinal channels in the side wall of the tubular member, and in which there are a multiplicity of orifices between the chamber in the insert member and the inlet portion of the longitudinal channels in the tubular member.

11. An adjustable spray device as set forth in claim 10 in which the orifices are located to simultaneously come into rotational alignment with the inlet portions of the longitudinal channels.

12. An adjustable spray device as set forth in claim 11 in which the projection is shaped and adapted to be received in an opening in an irrigation pipe, the projection substantially sealing the opening when received within it, the device further including means to hold it in a predetermined position relative to the area being subjected to spray as the irrigation pipe expands and contracts with changes in its environment.

13. An adjustable spray device as set forth in claim 12 in which the tubular member includes a restricted throat portion between the inlet portion and the outlet portion, the orifice between the chamber in the insert member and the outlet portion of the tubular member is shaped to vary the volume of liquid emitted from the device in a generally linear fashion as a function of angular change in the rotational adjustment of the insert member within the tubular member from a minimum to a maximum volume position, the means to hold the insert within the tubular member including interlocking circumferential shoulders on the insert member and the tubular member, and in which the tubular member also includes a restricted throat portion providing a stop against which may bear the end of a flexible liquid supply tube received within the inlet end of the tubular member, the restricted throat being longitudinally in line with the inlet chamber in the insert member.

14. An adjustable spray device as set forth in claim 13 in which the interlocking shoulders include interlocking serrations to hold the insert member in a multiplicity of rotational positions within the tubular member.

15. An adjustable spray device as set forth in claim 14 including a multiplicity of longitudinal channels in the side wall of the tubular member, and in which there are a multiplicity of orifices between the chamber in the insert member and the inlet portion of the longitudinal channels in the tubular member, the orifices being located to simultaneously come into rotational alignment with the inlet portions of the longitudinal channels.

16. An adjustable spray device as set forth in claim 2 in which the head of the insert member includes a projection for supporting the device in a given position.

* * * * *